US007481698B2

(12) United States Patent
Yamada et al.

(10) Patent No.: US 7,481,698 B2
(45) Date of Patent: Jan. 27, 2009

(54) SINTERED RARE EARTH MAGNETIC ALLOY WAFER SURFACE GRINDING MACHINE

(75) Inventors: Kiyoshi Yamada, Funabashi (JP); Hirofumi Takei, Honjou (JP); Masami Kamada, Oodate (JP); Toshinori Eba, Obanazawa (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

(21) Appl. No.: 11/889,872

(22) Filed: Aug. 17, 2007

(65) Prior Publication Data

US 2008/0051016 A1 Feb. 28, 2008

Related U.S. Application Data

(62) Division of application No. 11/227,151, filed on Sep. 16, 2005, now Pat. No. 7,273,405, which is a division of application No. 10/301,621, filed on Nov. 22, 2002, now Pat. No. 6,994,756.

(30) Foreign Application Priority Data

Nov. 28, 2001 (JP) ..... 2001-363313

(51) Int. Cl.
*B24B 7/00* (2006.01)

(52) U.S. Cl. ..... 451/261; 451/267; 451/269

(58) Field of Classification Search ..... 451/261, 451/262, 264, 265, 266, 267, 268, 269
See application file for complete search history.

(56) References Cited

U.S. PATENT DOCUMENTS

| | | | | |
|---|---|---|---|---|
| 3,846,940 | A * | 11/1974 | Dunn | 451/269 |
| 5,934,983 | A * | 8/1999 | Wada et al. | 451/63 |
| 6,080,048 | A * | 6/2000 | Kotagiri et al. | 451/285 |
| 6,280,304 | B1 * | 8/2001 | Nakamura et al. | 451/261 |
| 6,408,840 | B2 | 6/2002 | Ishida | |

(Continued)

FOREIGN PATENT DOCUMENTS

JP 2001-300842 4/2000

OTHER PUBLICATIONS

Metals Handbook Ninth Edition, vol. 16, 1989, pp. 121-123.

(Continued)

*Primary Examiner*—Timothy V Eley
(74) *Attorney, Agent, or Firm*—Clark & Brody

(57) ABSTRACT

A surface grinding machine for a sintered rare earth magnetic alloy wafer comprises a pair of disk-shaped grindstones that face each other across a prescribed gap to be rotatable in opposite directions about their center axes. The grinding surfaces of the pair of grindstones and the center axe inclination of one grinding stone are configured to form a planar grinding region A wherein a portion of both of the grinding surfaces of the pair of grindstones lie parallel with a constant intervening gap therebetween. Other portions of the grinding surfaces of the grindstones constitute a wedge-like opening region B that becomes more narrow toward the planar grinding surface A. A feeder to feed the wafers from the wedge-like opening region B toward the planar grinding region A is provided in order to grind both surfaces of the wafers at the planar grinding.

1 Claim, 6 Drawing Sheets

U.S. PATENT DOCUMENTS

| | | | | |
|---|---|---|---|---|
| 6,443,143 | B1 | 9/2002 | Ishida et al. | |
| 6,485,357 | B1 * | 11/2002 | Divine | 451/58 |
| 6,793,742 | B2 | 9/2004 | Sakaki et al. | |
| 6,994,756 | B2 * | 2/2006 | Yamada et al. | 148/101 |
| 7,150,674 | B2 * | 12/2006 | Okura | 451/8 |
| 7,273,405 | B2 * | 9/2007 | Yamada et al. | 451/1 |
| 2002/0115390 | A1 | 8/2002 | Kondo et al. | |
| 2003/0062098 | A1 | 4/2003 | Sakaki et al. | |
| 2004/0231134 | A1 | 11/2004 | Kondo et al. | |

OTHER PUBLICATIONS

Metals Handbook, Ninth Edition, vol. 16, 1989, pp. 453-456.

* cited by examiner

SINTERED RARE EARTH MAGNETIC ALLOY WAFER SURFACE GRINDING MACHINE

CROSS REFERENCE TO RELATED APPLICATIONS

This is a divisional of U.S. patent application Ser. No. 11/227,151 filed Sep. 16, 2005 now U.S. Pat. No. 7,273,405, which is a divisional of U.S. patent application Ser. No. 10/301,621 filed Nov. 22, 2002 now U.S. Pat. No. 6,994,756.

BACKGROUND OF THE INVENTION

1. Field of the Invention

This invention relates to a method of producing a thin plate of a sintered rare earth magnetic alloy having a hard ferromagnetic phase surrounded by a readily grindable grain boundary phase. The thin plate is called as a wafer in the specification.

2. Background Art

Sintered rare earth magnetic alloys composed mainly of Nd—Fe—B are considered to have a metallic structure consisting a ferromagnetic phase whose main phase is $Fe_{14}Nd_2B$ and, surrounding the ferromagnetic phase, a Nd-rich grain boundary phase (nonmagnetic or soft magnetic phase). These alloys can be used to produce high-performance magnets having an energy product (BHmax) of not less than 35 (MGOe). Various improvements have been achieved with respect to the poor corrosion resistance and oxidation resistance that have long been a matter of concern regarding these magnets, and also with respect to their various properties such as the temperature-dependence of their magnetic characteristics and relative low curie point. Advances achieved up to now are impressive even as viewed solely from the structural viewpoint. These include, for example, sintered rare earth magnetic alloys that have part of the Nd replaced with another light rare earth element or a heavy rare earth element, others that use Co as an alloying element, and still others that contain C (carbon) or that are appropriately balanced with other alloying elements.

In addition, the emergence of numerous improved methods for producing sintered rare earth magnetic alloys is adding to the store of technologies enabling economical production of good quality sintered rare earth magnetic alloys. One resent result is the extensive use of sintered rare earth magnetic alloys in equipment at the heart of precision electrical products and the like.

The present invention is aimed at enabling production of excellent quality wafers made of such sintered rare earth magnetic alloys. As used in this specification, the term "sintered rare earth magnetic alloys" encompasses not only sintered rare earth magnetic alloys composed primarily of Nd—Fe—B but all types of rare earth magnet sintered bodies including, for example, ones that are structurally characterized in that they have part of the Nd replaced with another rare earth element, incorporate Co as an alloying element, include C (carbon), or contain other alloying element(s). In this specification, these are referred to collectively as "Nd-system sintered rare earth magnetic alloys" or in abbreviated form as "sintered rare earth magnetic alloy." Typical of these are (Nd, R)—(Fe, Co)—(B, C)-system sintered magnetic alloys. Here, R designates rare earth elements other than Nd. All of these sintered rare earth magnetic alloys include magnetic crystal grains composed of an intermetallic compound. The magnetic crystal grains are surrounded by a (Nd, R)-rich grain boundary phase and a grain boundary phase containing a B-rich, Co-rich or C-rich phase. These grain boundary phases are generally softer and more brittle than the magnetic crystal grains composed of intermetallic compound. Although strictly speaking the composition of the intermetallic compound forming the magnetic crystal grains differs with the contained alloying elements, it is generally considered to be substantially $Fe(Co)_{14}Nd(R)_2(B, C)$.

A sintered rare earth magnet of this type is typically produced by following production steps such as shown in FIG. 1. Although the magnet is sometimes given its final shape in the step of press molding the alloy powder before sintering, in view of productivity considerations it is usually formed as a rod or cylinder that is cut into the individual forms of wafer after sintering.

As an example, consider the case of producing a wafer such as a thin disk-shaped sintered rare earth magnet measuring several mm or so in thickness and 10 mm in diameter. First, fine powder obtained by pulverizing the alloy to a particle diameter of 10 μm or finer is press-molded into a round rod of a length of, for example, 30 mm. To allow for contraction during sintering, the diameter of the press-molded rod is made larger than 10 mm at this time. The molding is conducted in a magnetic field so as to align the powdered alloy particles. The alignment is sometimes in the axial direction of the rod, sometimes perpendicular to the axial direction, and sometimes radial. This alignment is carried out if an anisotropic magnetic is desired. Actually, it is almost always conducted, because sintered rare earth magnets usually exhibit high performance as anisotropic magnets. When an isotropic magnet is to be obtained, alignment is not conducted and the crystal orientation is therefore random. The rod-shaped sintered product may or may not be heat treated before being sliced into disks (wafers) of about 2 mm thickness. The disks are bored at the center (if necessary) and are then magnetized to obtain magnets of the desired shape.

The cutting of the rod into thin pieces is done by slicing. Conventionally the slicing of a sintered rare earth magnetic alloy is done using either an external blade formed by adhering abrasive grains to the outer peripheral surface of a metal disk or an internal blade formed by adhering abrasive grains to the inner peripheral edge of a metal disk center hole. The external blade is more commonly used. Since the hardness of a sintered rare earth magnetic alloy is extremely high, on the order of a Vickers hardness of 500 or greater, ordinarily Hv 600-1000, the slicing of sintered rare earth magnetic alloys has come to be widely done using the highly technically advanced external blade (saw blade) developed for silicone wafer slicing and the like.

In this connection, the assignee filed Japanese Patent Application No. 2000-117764 for an alternative cutting method to that using an external blade. In this cutting method, a flexible wire of not greater than 1.2 mm diameter is pressed onto the sintered rare earth magnetic alloy and the wire is moved axially while supplying to between the alloy and the wire an abrasive fluid composed of abrasive grains dispersed in a dispersion medium. This cutting method was found to be capable of cutting sintered rare earth magnetic alloy into thin slices at high yield.

Sintered rare earth magnetic alloys are capable of exhibiting outstanding magnetic characteristics as small magnets. The shapes and sizes of such magnets for use in precision equipment have therefore become increasingly compact. The accuracy of the precision machining required has risen in proportion. In the case of sintered rare earth magnetic alloys for use in the miniature motors and speakers installed in mobile phones and audio devices, for example, the thin magnet wafers (including disk-, doughnut- square-shaped and the like) have to be finished to a thickness of under 1 mm, often to around 0.5 mm, and a ratio of thickness to planar surface area ratio of 0.05 or less.

In such case, when the sintered rare earth magnetic alloy is sliced into thin wafers with a cutter, surface irregularities are likely to occur owing to the distinctive structure of the sintered rare earth magnetic alloy. Specifically, as pointed out above, the sintered rare earth magnetic alloy has an extremely high hardness of around Hv 500-1000 and, in addition, has a structure consisting of hard magnetic crystal grains composed of intermetallic compound dispersed in a soft grain boundary phase. Surface irregularities therefore occur because the magnetic crystal grains are not sliced through but remain sticking out from the surface from place to place (as though only the fine grains of the grain boundary phase were scraped off). Nicks, saw marks and the like are also apt to be formed in the cut surface. Owing to these circumstances, difficulty has been experience in slicing wafers exhibiting a flat, smooth surface from a sintered rare earth magnetic alloy.

The sintered rare earth magnetic alloy may be cut to a very thin wafer thickness of under 3 mm, or even under 1 mm. If the planar surface smoothness of the wafer is poor and the magnetized wafer magnet obtained from it is mounted on a component having a flat surface, gaps will remain between the magnet and the component surface. Strain will arise in the wafer owing to the strong magnetic force acting between the two (A sintered rare earth magnetic can achieve a BHmax of 35 MGOe or greater). The wafer may not have sufficient strength to resist the strain, in which case it will break.

Even if it does not break, its performance will be degraded by the lack of a flat surface owing to the adverse effect on the distribution of the magnetic flux density from the wafer surface. When a wafer magnet with inferior planar surface flatness is used in a small motor or speaker, for example, the unevenness of its magnetic force will produce irregular vibration. When it is used in a step motor, the gap between itself and the yoke will increase to cause magnetizing loss. In addition, defective bonding may occur when the magnet is mounted.

SUMMARY OF THE INVENTION

Thus, while sintered rare earth magnets, particularly wafer magnet products, are required to have especially good planar surface properties, the aforesaid hardness and distinctive metallic structure of sintered rare earth magnetic alloys have made it fundamentally difficult to machine such alloys into wafer magnets having satisfactory surface properties. An object of the present invention is to overcome this difficulty.

The present invention provides a method of producing a sintered rare earth magnetic alloy wafer comprising: a step of using a cutter to slice a wafer of a thickness of not greater than 3 mm, preferably not greater than 2 mm and more preferably not greater than 1 mm from a sintered rare earth magnetic alloy having ferromagnetic crystal grains surrounded by a more readily grindable grain boundary phase; and a step of surface-grinding at least one cut surface of the obtained wafer with a grindstone to form at a surface layer thereof flat ferromagnetic crystal grain cross-sections lying parallel to the wafer planar surface. The cutting of the wafer is preferably done by slicing a rod of the sintered rare earth magnetic alloy in a direction perpendicular to its axis using an external blade cutter or a wire saw. The surface grinding is preferably done by contacting the cut surface of the wafer with the face of a disk-shaped grindstone rotating around its center axis (preferably one embedded with diamond abrasive grains) under supply of a coolant. This results in the appearance at the wafer planar surface of magnetic crystal grain flat cross-sections lying parallel to the wafer planar surface and enables production of a sintered rare earth magnetic alloy wafer having a surface with a surface roughness Rmax of not greater than 8 μm.

The present invention also provides a surface grinding machine for a sintered rare earth magnetic alloy comprising: a pair of disk-shaped grindstones that face each other across a prescribed gap to be rotatable in opposite directions about their center axes, one of which axes is inclined by not greater than 10 degrees with respect to the other, the machine being adapted to grind surfaces of a wafer of a sintered rare earth magnetic alloy by passing the wafer one-directionally through the gap.

DESCRIPTION OF THE PREFERRED EMBODIMENTS

Figure 1:
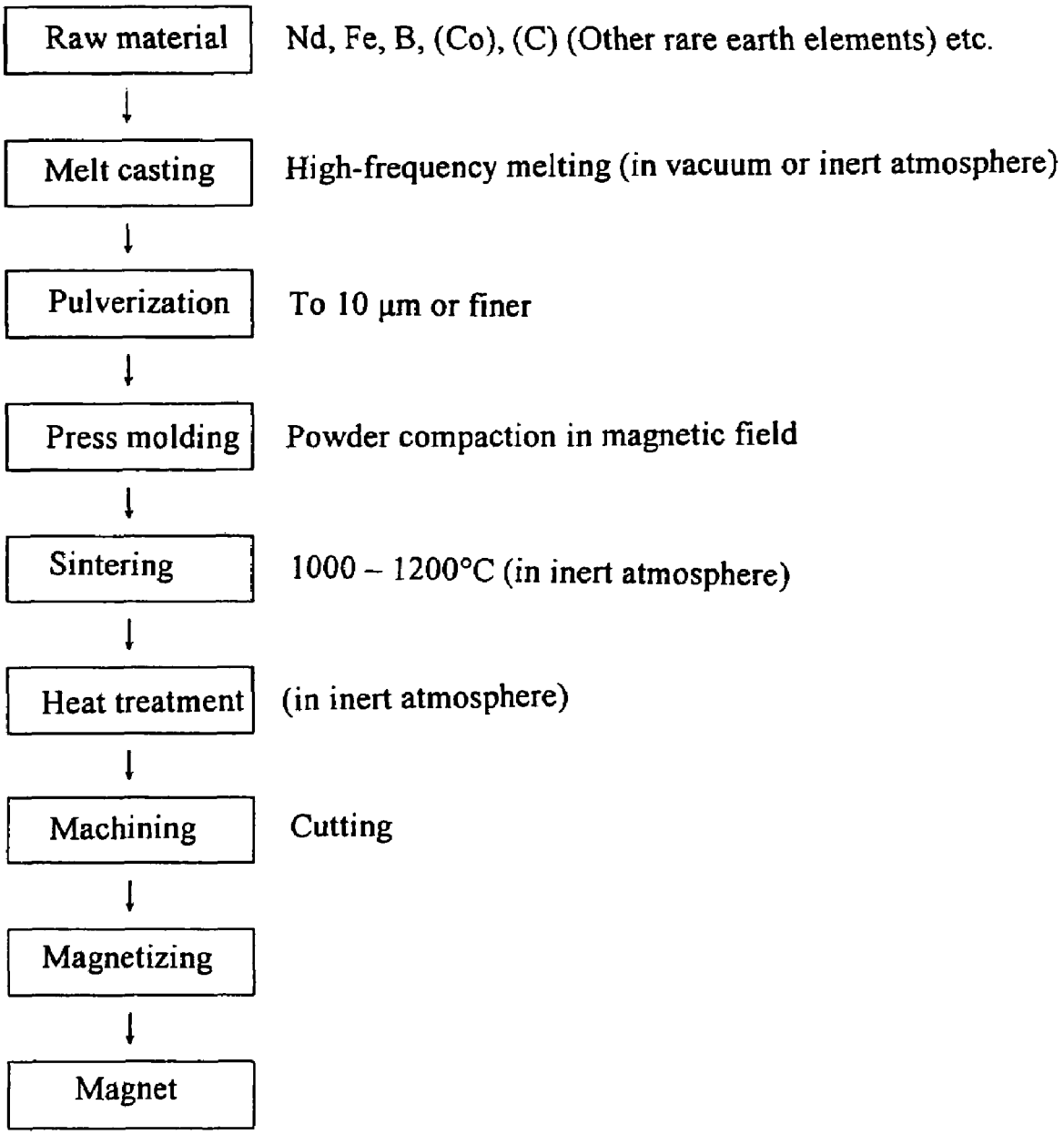
FIG. 1 is a process chart illustrating an example of a common method for producing a sintered rare earth magnetic alloy.
Figure 2:
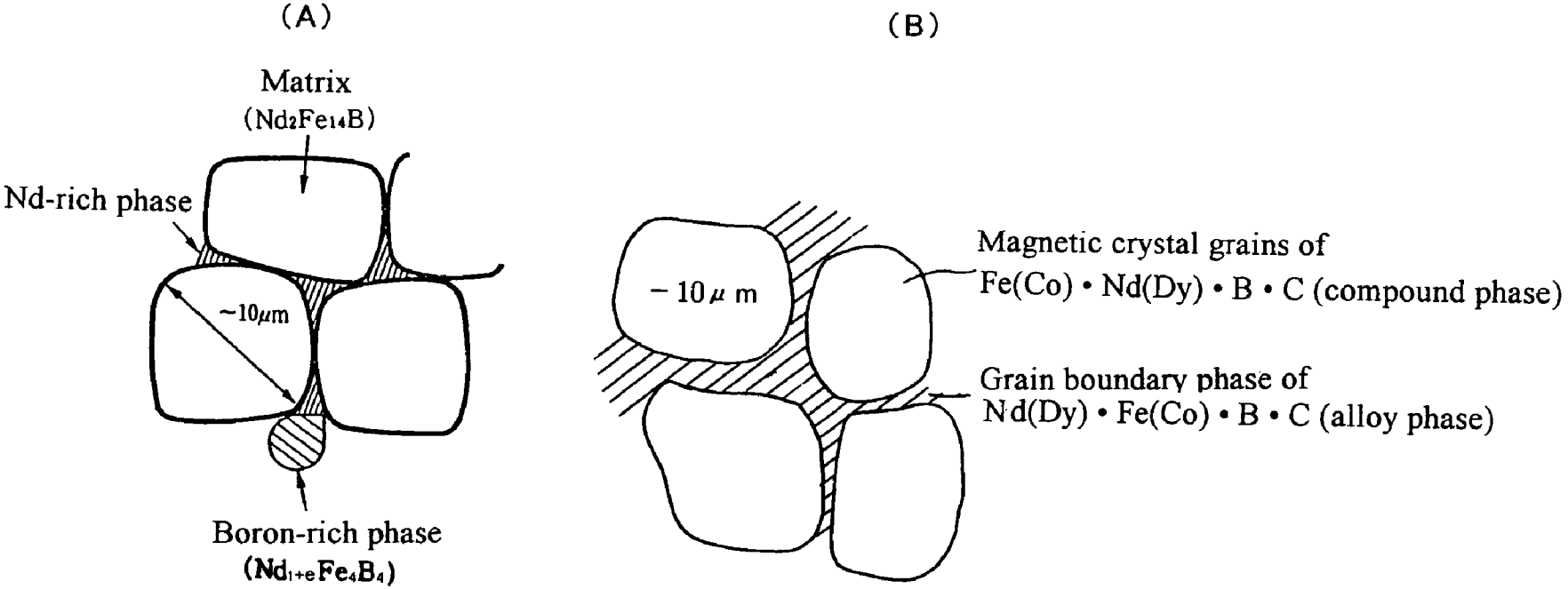
FIG. 2 is a set of explanatory views diagrammatically illustrating typical metallic structures of sintered rare earth magnetic alloys.

FIG. 2(A) diagrammatically illustrates the structure of a sintered rare earth magnetic alloy, specifically of a sintered magnetic alloy composed primarily of Nd—Fe—B. As shown, the metallic structure consists of approximately 10 μm-diameter ferromagnetic crystal grains of $Fe_{14}Nd_2B$ (the matrix) surrounded by a Nd-rich phase (Fe—Nd phase of body centered cubic; soft magnetic phase) and a boron-rich phase (nonmagnetic phase of $Nd_{1+e}Fe_4B_4$, $Nd_2Fe_7B_6$ or the like) present as a grain boundary phase. After the Nd-rich phase has been formed around the $Fe_{14}Nd_2B$ phase in a stable state with a uniform boundary surface by, for example, heat treatment after sintering, it is possible to prevent the phenomenon occurring when a reverse magnetic field is applied of the reverse magnetic domain nuclei that first appear in the Nd-rich phase crossing the grain boundary to invade and grow in the $Fe_{14}Nd_2B$ phase. This is said to be what enables a strong coercive force to be maintained.

FIG. 2(B) diagrammatically illustrates the structure of a (Nd, Dy)—(Fe, Co)—(B, C)-system sintered rare earth magnetic alloy having Nd partially replaced by Dy and containing Co and C. This metallic structure similarly consists of approximately 10 μm-diameter ferromagnetic crystal grains of Fe(Co).Nd(Dy).B.C (compound phase) surrounded by a grain boundary phase containing Nd, Dy, Fe, Co, B and C (alloy phase). Like what was explained above, the presence of this grain boundary phase also plays an important role in imparting a strong coercive force to the magnetic crystal grains, while the presence of C (carbon) helps to upgrade corrosion resistance and oxidation resistance to the sintered rare earth magnetic alloy.

The sintered rare earth magnetic alloys to which the present invention applies encompass not only Nd—Fe—B-system believed to contain the aforesaid $Fe_{14}Nd_2B$ intermetallic compound but also ones that have part of the Nd replaced with another light rare earth element and/or heavy rare earth element, ones improved in curie point by inclusion of Co, ones enhanced in corrosion resistance and heat resistance by inclusion of C, and ones improved in various other properties by inclusion of other alloying elements. They are characterized in the point that their metallic structures consist of hard ferromagnetic crystal grains surrounded by a softer grain boundary phase. While the actual hardness of the "softer" phase is difficult to measure, the term "softer" as used here means "more mildly bonded and brittle" than the ferromagnetic crystal grains. By extension, "softer" therefore more means "more easily removed by abrasion and impact" than the magnetic crystal grains. This property of the grain boundary phase is also expressed as "ready grindable" in this specification.

Nd-system sintered magnets capable of achieving a high energy product owing to the foregoing distinctive metallic structure are hard-brittle in nature owing to the dispersion of large magnetic crystal grains composed of extremely hard intermetallic compound dispersed in soft and brittle grain boundary phase (alloy phase) containing various components. The metallic structure is therefore a troublesome one from the viewpoint of machining. And, in fact, when wafer slicing is conducted by cutting with the ordinarily adopted external blade, any attempt to increase the cutting speed leads to nicking and a defective sliced surface. Slicing of thin wafers has therefore been found difficult. The specific difficulties encountered are that the blade edge is unavoidably worn during cutting the hard magnetic crystal grains and that cracks occur because the crystal grains tend to be stripped away. A high percentage of defective products therefore inevitably occur when cutting is done with an external blade because the edge of such a blade imparts strong stress to the cut surface. This has made it impossible to achieve desired results in terms of productivity and yield, particularly when slicing the sintered body into wafers of under 3 mm thickness, and even more so when slicing it into thin wafers of under 2 mm or under 1 mm thickness.

The method taught in the assignee's Japanese Patent Application No. 2000-117764 was developed for overcoming this problem. In a typical configuration, called the "wire saw method," this method for cutting a sintered rare earth magnetic alloy is characterized in: bundling multiple sintered rods composed of a sintered rare earth magnetic alloy having ferromagnetic crystal grains surrounded by a more readily grindable grain boundary phase with their axes in parallel; pressing a flexible wire of not greater than 1.2 mm diameter onto the bundle of sintered rods in a direction perpendicular to the rod axes: and moving the wire axially while interposing an abrasive fluid composed of abrasive grains dispersed in a dispersion medium between the sintered rods and the wire. When this method is used, a phenomenon arises at the cut surface stuck by the abrasive grains whereby the readily grindable grain boundary phase is preferentially stripped away. Slicing into thin wafers can therefore be achieved with good productivity and no occurrence of cracking. The cut surface in this case appears substantially like what is shown in FIG. 3 when observed with an electron microscope.

Figure 3:
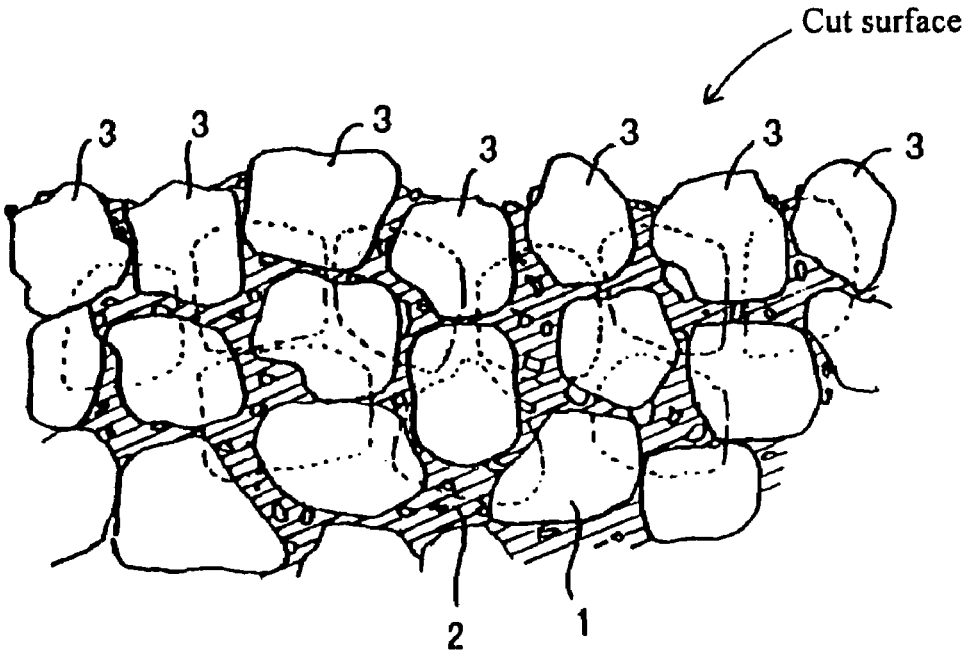
FIG. 3 is a substantially cross-sectional view diagrammatically illustrating the cut surface of a sintered rare earth magnetic alloy taken perpendicular to the cut surface.

FIG. 3 diagrammatically illustrates the cross-sectional condition of the sintered rare earth magnetic alloy cut with the wire saw when observed through an electron microscope. The surface cut by the wire saw (indicated by the arrow) lies perpendicular to the drawing sheet. In FIG. 3, reference numeral 1 designates the ferromagnetic crystal grains in the sintered rare earth magnetic alloy other than those exposed at the cut surface, which are designated by reference numeral 3. Reference numeral 2 designates the grain boundary phase. When cutting is done with an external blade, the rigid blade makes direct contact with the material being cut. In contrast, the wire saw does not directly contact the material being cut (the wire breaks if it does). Instead, the abrasive grains in the abrasive fluid accompanying the wire movement collide with the material being cut. This collision of the abrasive grains produces a phenomenon by which the grain boundary phase 2 is scraped off. The ferromagnetic crystal grains 3 therefore poke out from the cut surface removed of the grain boundary phase 2. In other words, most of the ferromagnetic crystal grains 3 present at the cut surface experience substantially no truncation and maintain their original diameters, with about half of each grain buried in the matrix and the other half protruding out of the matrix. While some of the ferromagnetic crystal grains present at the cut surface are truncated, they account for only a small percentage of the total.

Owing to these conditions, almost no grain boundary phase remains at the cut surface, so that ferromagnetic crystal grains 3, which are exposed in their original diameters, make the surface irregular and bumpy. (Cracks rarely form through the grain boundary phase at the surface cut by the wire saw.) Although this irregular surface may be advantageous in cases where the surface is to be coated, it is undesirable in the case of wafer magnet products because it adversely affects the magnetic characteristics and may cause cracking when magnetization is conducted.

In search of a way of improving the surface properties of sintered rare earth magnetic alloy wafers having such cut surfaces, the inventors tested surface grinding using grindstones. As a result, we learned that when surface grinding is suitably conducted, the ferromagnetic crystal grains 3 and 1 are ground (sectioned) even through the grains to afford a very smooth surface state free of surface bumpiness like that shown in FIG. 3.

Figure 4:
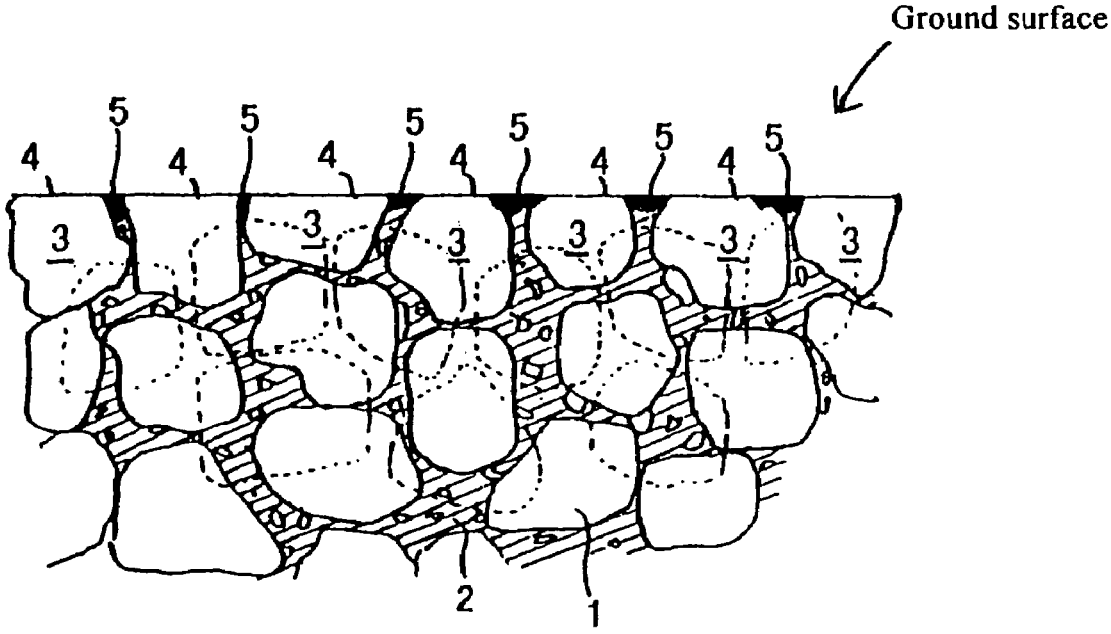
FIG. 4 is a substantially cross-sectional view illustrating a surface-ground face of a sintered rare earth magnetic alloy taken perpendicular to a cut surface.

FIG. 4 is a sectional view, represented similarly to that of FIG. 3, showing the result obtained when the irregular surface of FIG. 3 was surface-ground in accordance with the present invention. As shown in FIG. 4, the ferromagnetic crystal grains 3 that were present at the cut surface were truncated to form new ground surfaces 4 parallel to the wafer planar surface. In addition, the locations where the grain boundary phase 2 can be assumed to have been present were newly formed with surfaces 5 lying parallel to the wafer planar surface. The composition of the surface 5 portions was found to be substantially the same as that of the ground surface 4 portions of the ferromagnetic crystal grains 3. In other words, the entire ground surface is covered with a smooth layer of a substance having substantially the same composition as the ferromagnetic crystal grains. Although the reason for this is not entirely clear, it is reasonable to conclude that fine particles of the ground ferromagnetic crystal grains filled in the adjacent gaps to produce a smooth surface of uniform composition. It is possible that the mechanism that produces such a flat ground surface can operate not only when the cut surface is cut with a wire saw but also when it is cut with an external blade.

The surface grinding applied to a sintered rare earth magnetic alloy wafer in the present invention will now be explained in further detail.

Figure 5:
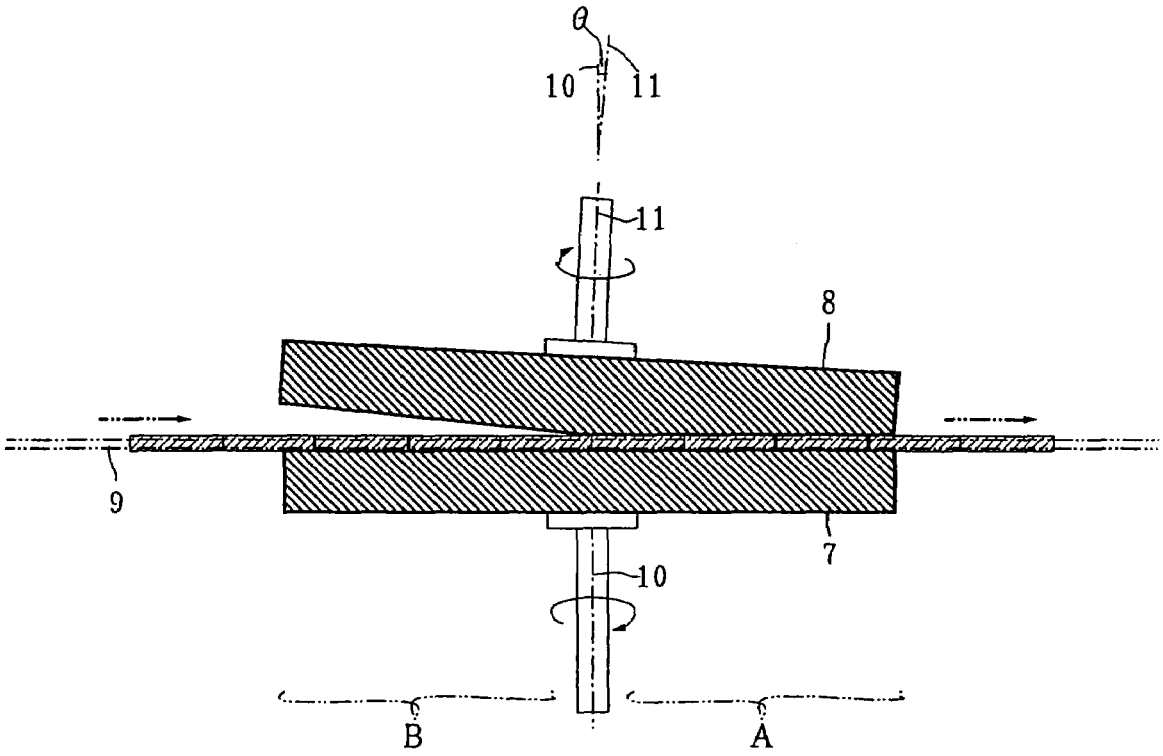
FIG. 5 is a substantially sectional view of an essential portion of a sintered rare earth magnetic alloy surface grinding machine according to the present invention.
Figure 6:
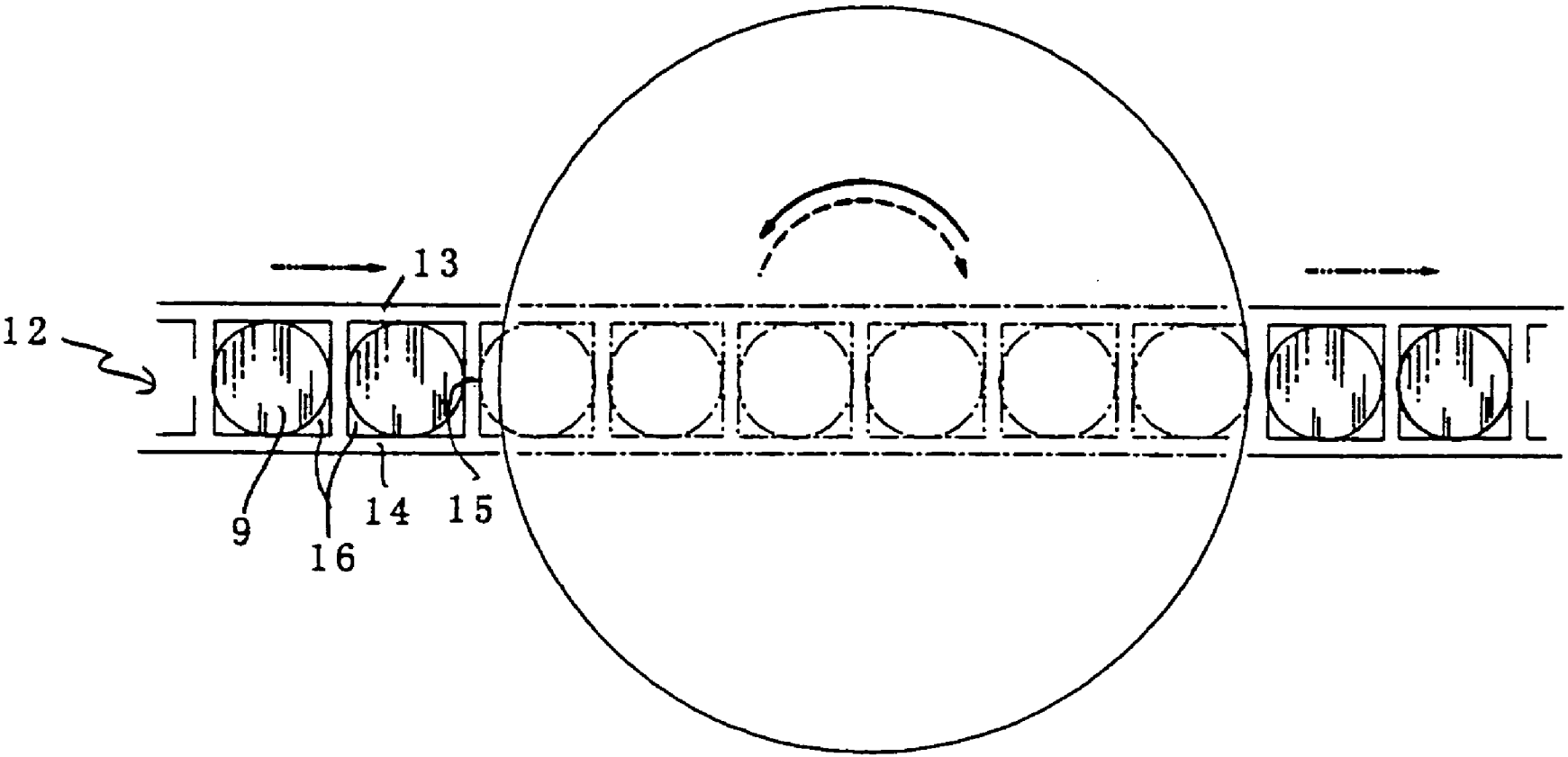
FIG. 6 is a substantially plan view of an essential portion of a sintered rare earth magnetic alloy surface grinding machine according to the present invention.

The essential portion of a typical surface grinding machine adopted in the present invention is shown in FIGS. 5 and 6. As can be seen in FIG. 5, this surface grinder has a pair of disk-shaped grindstones 7 and 8 (bottom grindstone 7 and top grindstone 8) that face each other across a prescribed gap to be rotatable in opposite directions about their center axes. The surfaces of a sintered rare earth magnetic alloy wafer 9 are ground by passing the wafer 9 one-directionally through the gap. The grindstones 7 and 8 are arranged so that the center axis of rotation 11 of one (top) grindstone 8 is offset by not greater than 10 degrees with respect to the center axis of rotation 10 of the other (bottom) grindstone 7. In the illustrated example, the grinding surface of the bottom grindstone 7 is flat throughout and rotates about the center axis 10 lying perpendicular to the surface. In the example shown in FIG. 5, the grinding surface of the top grindstone 8 is formed to slope in the manner of an umbrella from the center of the disk (or from a point a prescribed distance away from the center axis 10) and the center axis 11 is inclined so that the sloped grinding surface lies parallel to the wholly flat grinding surface of the bottom grindstone. The grindstones 7 and 8 are rotated in opposite directions about their center axes 10 and 11 in this condition. In the present embodiment, the offset angle θ of the center axis 11 relative to the center axis 10 is 3 degrees.

Figure 7:
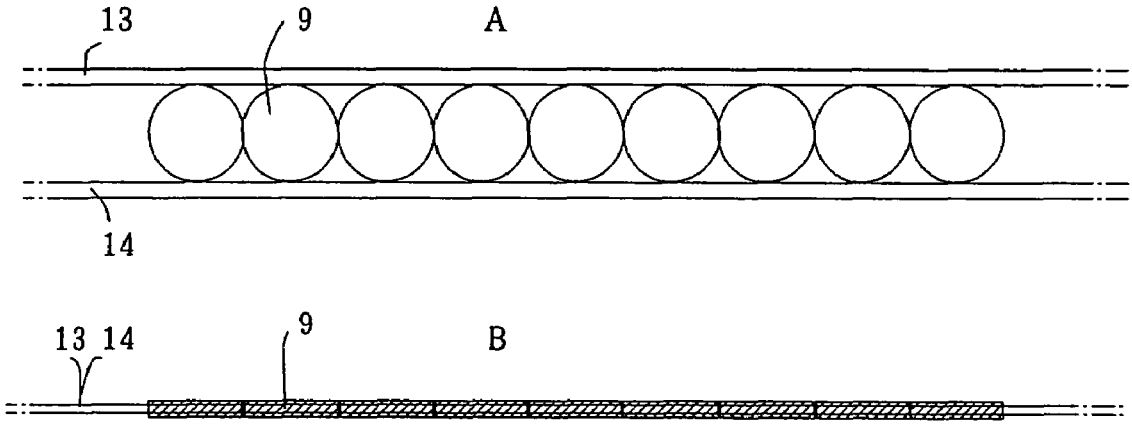
FIG. 7 is a set of drawings consisting of a plan view (A) and a side sectional view (B) of a feeder of a sintered rare earth magnetic alloy surface grinding machine according to the present invention.

As viewed in FIG. 5, this configuration forms on the right side of the axes 10, 11 a planar grinding region A where the top and bottom grinding surfaces lie parallel (the intervening gap is constant) and on the left side a wedge-like opening region B where the gap between the top and bottom grinding surfaces grows larger toward the left side. The machine can be operated as a continuous surface grinding machine by continuously feeding the objects to be ground, i.e., wafers 9, from the wedge-like opening region B toward the planar grinding region A. The feeding of the wafers can be conducted using the feeder 12 shown in FIG. 6. The feeder 12, which is shaped like a ladder, consists of two parallel sidepieces 13 and 14 connected by regularly spaced perpendicular crosspieces 15 to form a series of square openings 16 in the longitudinal direction. The thickness of the sidepieces 13 and 14 and the crosspiece 15 is made thinner than that of the wafers 9 to be ground. The wafers 9 are mounted in the square openings 16 and, as shown in FIG. 6, are fed at a constant speed from the wedge-like opening region B toward the planar grinding region A. Both surfaces of the wafers 9 are therefore ground at the planar grinding region A where they come into surface contact with the oppositely rotating top and bottom grinding surfaces. The surface grinding is preferably conducted while supplying an appropriate coolant to the planar grinding region A because the magnetic characteristics of the wafers will be degraded if their temperatures increase excessively owing to the heat of friction. Alternatively, as shown in FIGS. 7A and 7B, the feeder 12 can be constructed only of the two parallel sidepieces 13 and 14, i.e., without the crosspiece 15 of FIG. 6. In this case, the wafers 9 are mounted between the sidepieces 13 and 14 with adjacent ones in contact with each other, whereafter they are fed from the wedge-like opening region B to the planar grinding region A at constant speed.

The inventors learned that cracking is apt to occur in the wafers 9 if the gap between the two grindstones 7 and 8 is uneven at the point where the wafers 9 exit the planar grinding region A and further that cracking is also apt to occur in the wafers 9 if the wedge-like opening region B is omitted. The length over which the parallel gap is formed between the grindstones 7 and 8 at the planar grinding region A can be substantially equal to the radius of the disk-shaped grindstones as shown in the figures. Actually, however, where the radius of the disk-shaped grindstones is defined as r, it suffices for the length over which the parallel gap is formed to be within the range of around r/4-3r/4 measured from the outer periphery inward. Moreover, while the top grindstone 8 is given the umbrella-like slope in the illustrated configuration, the bottom grindstone 7 can instead be provided with an umbrella-like slope, or both of the grindstones 7 and 8 can be formed with umbrella-like slopes. What is important is that the offset angle at the point where the center axes of the two grindstones meet be not greater than 10 degrees. The preferable offset angle is 1-4 degrees.

Diamond grindstones, i.e., grindstones dispersed with artificial diamond particles, are preferably used as the grindstones 7 and 8. In some cases it is possible to employ silicon carbide grindstones dispersed with silicon carbide particles.

When the machine described in the foregoing is used, surface grinding of sintered rare earth magnetic alloy wafers can be conducted without cracking in the case of very thin products of a thickness under 3 mm and, in some cases, even under 2 mm or under 1 mm. Moreover, the flat cross-sections of the ferromagnetic crystal grains appear in parallel with the wafer planar surface to achieve a flat and smooth surface of a flatness of not greater than 8 μm, preferably not greater than 5 μm. In this case, the profile of the planar surface of the sintered rare earth magnetic alloy wafer is not limited to circular as shown in FIG. 6 but can instead be square, polygonal or elliptical. In addition, it is also possible to similarly surface-grind wafers bored with a hole within any of such planar surface profiles (e.g., a ring-shaped wafer).

Flatness can be represented as the difference between the maximum height and the minimum height measured by placing the subject of measurement (wafer) on a flat reference table and sliding the feelers of a surface contour measuring instrument in two intersecting directions. "Flatness" as termed in this specification means the difference between the maximum height and the minimum height of a plane measured in this manner. One example of a surface contour measuring instrument usable for this purpose is the Contourecord 2600B manufactured by Tokyo Seimitsu Co., Ltd. of Japan.

WORKING EXAMPLES

Example 1

The production process set out in Example 8 of the assignee's Japanese Patent No. 2779654 was used to produce a hollow cylindrical rod measuring 25 mm in outer diameter, 10 mm in inner diameter and 30 mm in length that was composed of a sintered rare earth magnetic alloy (hardness: Hv 650) of the same composition as that in said Example 8 (i.e., 18Nd-61Fe-15Co-1B-5C: the numerals representing at. %) and had the same metallic structure as that shown in FIG. 2 of the same patent (i.e., a metallic structure composed of approximately 10 μm ferromagnetic crystal grains surrounded by an Nd-rich grain boundary phase). The hollow cylindrical rod (test piece) was cut into 1-mm thick wafers by slicing it perpendicularly to its axis with a wire saw equipped with a 0.2 mm-diameter steel wire (with brass-plated surface) and a silicon carbide type abrasive fluid. As a result, there were obtained ring-shaped wafers measuring 25 mm in outer diameter, 10 mm in inner diameter and 1 mm in thickness. The temperature of the abrasive fluid supplied to the wire during the cutting operation was controlled to a constant 25° C.

Although the cut surfaces of the obtained ring-shaped wafers looked good to the naked eye, when a cross-section of the cut surface of a wafer was observed with an electron microscope it was found that, as diagrammatically illustrated in FIG. 3, the cut surface was cut along the boundaries of the ferromagnetic crystal grains so that a half body of each grain was exposed in a protruding state. The surface roughness and flatness of the cut surface was measured. As can be seen from the results are shown in Table 1, the surface roughness was Ra=1.7 μm, Rmax=16.2 μm and Rz=5.6 μm and the flatness was 25.1 μm.

The ring-shaped wafers were surface-ground on both sides using the surface grinding machine shown in FIGS. 5 and 6. The specification of the surface grinding machine and the grinding conditions are as follows.

Top grindstone: Diamond grindstone of 305 mm outer diameter having a grinding surface width (width of the umbrella in FIG. 5) of 155 mm extending from the periphery inward.

Bottom grindstone: Diamond grindstone of 305 mm outer diameter having a flat grinding surface.

Grindstone rotational velocity: Top grindstone=Circumferential velocity of 766 m/min, Bottom grindstone=Circumferential velocity of 766 m/min in opposite direction.

Coolant: Soluble type

Coolant supply rate: 50 L/min

Feeding velocity of feeder: 180 mm/sec

Grinding period per wafer: 1.6 sec.

The surface roughness and flatness of the surface-ground products were measured. As can be seen from the results shown in Table 1, the surface roughness was Ra=0.8 μm, Rmax=5.2 μm and Rz=3.8 μm and the flatness was 2.0 μm. When a cross-section of the cut surface of a wafer was observed with an electron microscope it was found that, as diagrammatically illustrated in FIG. 4, new ground surfaces (flat cross-sections) 4 were formed parallel to the wafer planar surface and the locations where the grain boundary phase 2 can be assumed to have been present were newly formed with surfaces 5 lying parallel to the wafer planar surface. Microscopic observation of the ground surface two-dimensionally showed that substantially all of the grain boundaries present in the cut surface (the concavities surrounding the magnetic crystal grains) had disappeared to produce a flat ground surface. Examination of individual points of the ground surface showed that the sites of the ferromagnetic crystal grains and those where the grain boundaries were thought to have been present previously all had substantially the same composition and the entire ground surface was covered with a smooth layer of a substance having substantially the same composition as the ferromagnetic crystal grains 3.

The cut products and the surface-ground products of this Example were evaluated for magnetized strength. The magnetized strength was evaluated in terms of "magnetic impact cracking height" as determined by the following magnetic impact cracking test.

Magnetic Impact Cracking Test

An 8 mm-thick 35×22 mm rare earth magnet disk (Nd—Dy—Fe—Co—B-system magnetic with BHmax of 35 MGOe) was seated on a 15 mm-thick 60×60 mm steel base and overlaid with a polyvinyl chloride plate spacer. A wafer magnet specimen was placed on the spacer. All tested wafer magnet specimens had been processed to have their easy magnetizing axes in the thickness direction and unipolarly magnetized in a magnetic flux of 45 KOe. The test was conducted by horizontally pulling out the spacer so that the wafer specimen collided with the rare earth magnet base under the force of magnetic attraction and gravity, checking whether the wafer specimen was cracked by the impact, and repeating the process with spacers of increasing thickness.

Magnetic Impact Cracking Height

The same wafer magnet specimen was subjected to the magnetic impact cracking test using spacers of different thickness and the thickness of the spacer (drop height) at which cracking occurred was defined as the magnetic cracking height. A wafer specimen with a higher magnetic impact cracking height was given a higher magnetized strength rating. Spacers of 1 mm, 2 mm, 3 mm, 4 mm, 5 mm, 8 mm and 10 mm thickness were used successively for each specimen in the order mentioned. The test was terminated when cracking occurred. The average value obtained in three tests was used as the test result. The results are shown in Table 1. As can be seen from Table 1, the magnetic impact cracking height of the cut products averaged 1.3 mm, while the magnetic impact cracking height of the surface-ground products averaged 2.7 mm.

Example 2

The specimen was a rod measuring 7 mm in outer diameter and 30 mm in length consisting of a sintered rare earth magnetic alloy composed of 18Nd-76Fe-6B and having a metallic structure composed of ferromagnetic crystal grains of an average diameter of 5 μm surrounded by an Nd-rich grain boundary phase. The same procedures as those in Example 1 were repeated except that the rod was sliced into disk-shaped wafers of 7 mm diameter and 1.0 mm thickness.

Cut products and ground products obtained by surface-grinding cut products were measured for surface roughness, flatness and magnetic impact cracking height. The results are shown in Table 1.

Examples 3 and 4

A 7 mm-diameter rod composed of a sintered rare earth magnetic alloy of the same composition as that of Example 1 was sliced into many disk-shaped wafers of 1.0 mm-thickness (Example 3) and 0.7 mm-thickness (Example 4) using a wire saw. The wafers were surface-ground in the manner of Example 1. Cut products and products obtained by surface-grinding cut products were measured for surface roughness, flatness and magnetic impact cracking height. The results are shown in Table. 1.

Example 5

A 7 mm-diameter rod composed of a sintered rare earth magnetic alloy of the same composition as that of Example 1 was sliced into disk-shaped wafers of 1.0 mm-thickness using an external blade. The wafers were surface-ground in the manner of Example 1. Cut products and products obtained by surface-grinding cut products were measured for surface roughness, flatness and magnetic impact cracking height. The results are shown in Table. 1.

TABLE 1

| No. | Alloy composition | Wafer thickness/ planar surface area | Surface type | Surface roughness (μm) Ra | Rmax | Rz | Flatness (μm) | Magnetic impact cracking height N = 3 ave (mm) |
|---|---|---|---|---|---|---|---|---|
| 1 | 18Nd—61Fe—15Co—1B—5C | 0.0036 | Cut | 1.7 | 16.2 | 5.6 | 25.1 | 1.3 |
| | | | Ground | 0.8 | 5.2 | 3.8 | 2.0 | 2.7 |
| 2 | 18Nd—76Fe—6B | 0.026 | Cut | 2.0 | 12.5 | 9.5 | 10.9 | 2.7 |
| | | | Ground | 0.8 | 5.0 | 3.1 | 0.8 | 5.0 |
| 3 | 18Nd—61Fe—15Co—1B—5C | 0.026 | Cut | 1.9 | 11.3 | 8.6 | 5.7 | 2.3 |
| | | | Ground | 0.8 | 4.6 | 3.0 | 0.8 | 6.0 |
| 4 | 18Nd—61Fe—15Co—1B—5C | 0.018 | Cut | 3.2 | 14.5 | 11.3 | 16.7 | 3.7 |
| | | | Ground | 0.7 | 5.8 | 3.3 | 0.8 | 4.3 |
| 5 | 18Nd—61Fe—15Co—1B—5C | 0.026 | Cut | 1.0 | 7.0 | 5.4 | 5.8 | 2.7 |
| | | | Ground | 0.8 | 4.5 | 3.1 | 0.8 | 5.3 |

The results in Table 1 demonstrate that, as compared with the wafers having cut (but unground) surfaces, those that had been surface-ground exhibited good surface roughness and flatness indicative of excellent smoothness and were also excellent in magnetic impact cracking height.

As explained in the foregoing, the present invention enables production of very thin sintered rare earth magnetic alloy wafers of a thickness of 1 mm or less. In addition, the sintered rare earth magnetic alloy wafers produced by the invention method feature surfaces whose hard ferromagnetic crystal grains are ground parallel to the wafer planar surface and that have few irregularities at the grain boundary portions. As a result, the invention wafers are resistant to cracking in the magnetized state and experience little degradation of magnetic characteristics. Owing to these properties, they do not become a cause of irregular vibration or magnetizing loss when used in small motors, speakers and the like and can therefore make a marked contribution to improving the performance of precision equipment and telecommunications components.

What is claimed is:

1. A surface grinding machine for a sintered rare earth magnetic alloy wafer comprising:

a pair of disk-shaped grindstones that face each other across a prescribed gap to be rotatable in opposite directions about their center axes, wherein a grinding surface of one of the grindstones is formed to slope in a manner of an umbrella from the center of the disk or from a point a prescribed distance away from the center of the disk, and a center axis of the one grindstone is inclined so that the sloped grinding surface of the one grindstone lies parallel to a wholly flat grinding surface of the other grindstone, thereby forming: (i) a planar grinding region A where both of the grinding surfaces of the pair of grindstones lie parallel with a constant intervening gap therebetween, and (ii) a wedge-like opening region B where a gap between the grinding surfaces in the wedge-like opening region B becomes narrow toward the planar grinding surface A, and a feeder to feed wafers from the wedge-like opening region B toward the planar grinding region A in order to grind both surfaces of the wafers at the planar grinding region A where they come into surface contact with both of the oppositely rotating grinding surfaces, wherein the feeder has a series of square openings in the longitudinal direction in which the wafers are mounted.

* * * * *

UNITED STATES PATENT AND TRADEMARK OFFICE

CERTIFICATE OF CORRECTION

PATENT NO. : 7,481,698 B2
APPLICATION NO. : 11/889872
DATED : January 27, 2009
INVENTOR(S) : Yamada et al.

It is certified that error appears in the above-identified patent and that said Letters Patent is hereby corrected as shown below:

The Assignee should be listed as DOWA HOLDINGS CO., LTD., Tokyo, Japan

Signed and Sealed this
Seventeenth Day of April, 2012

David J. Kappos

David J. Kappos
*Director of the United States Patent and Trademark Office*